US006305331B1

(12) United States Patent
Fullemann et al.

(10) Patent No.: US 6,305,331 B1
(45) Date of Patent: Oct. 23, 2001

(54) BOILER FITTED WITH A BURNER

(75) Inventors: Jorg Fullemann, Mastrils; Heinrich Boner, Malans; Andreas Allemann; Marco Allemann, both of Untervaz, all of (CH)

(73) Assignee: VTH - Verfahrenstechnik fur Heizung AG, Liechtenstein (LI)

( * ) Notice: Subject to any disclaimer, the term of this patent is extended or adjusted under 35 U.S.C. 154(b) by 0 days.

(21) Appl. No.: 09/402,133

(22) PCT Filed: Mar. 23, 1998

(86) PCT No.: PCT/CH98/00112

§ 371 Date: Jan. 3, 2000

§ 102(e) Date: Jan. 3, 2000

(87) PCT Pub. No.: WO98/43019

PCT Pub. Date: Oct. 1, 1998

(30) Foreign Application Priority Data

Mar. 24, 1997 (CH) ..... 0718/97
Mar. 24, 1997 (CH) ..... 0719/97
Mar. 24, 1997 (CH) ..... 0720/97

(51) Int. Cl.[7] ..... F22B 9/08
(52) U.S. Cl. ..... 122/18.3; 122/44.1
(58) Field of Search ..... 122/18.3, 18.31, 122/44.1, 44.2, 51, 90, 101

(56) References Cited

U.S. PATENT DOCUMENTS 2,216,809 * 10/1940 Derby ..... 122/18.31
3,638,621 * 2/1972 Craig ..... 122/149
4,989,549 * 2/1991 Korenberg ..... 122/44.2
5,022,379 * 6/1991 Wilson, Jr. ..... 122/18.3
5,313,914 * 5/1994 Woollen ..... 122/18.3
5,437,248 * 8/1995 Miura et al. ..... 122/18.31

* cited by examiner

*Primary Examiner*—Gregory Wilson
(74) *Attorney, Agent, or Firm*—Baker & Daniels

(57) ABSTRACT

This invention concerns a boiler fitted with a burner suitable for wall heaters or built-in kitchen heaters in which a mantle-shaped heat exchanger made of pipe elements connected in parallel and/or series divides the boiler chamber into a combustion chamber and an exhaust chamber. The heat exchanger has openings for hot flue gases distributed over its mantle. The burner head disposed in the combustion chamber is suitable for burning oil and has a flame tube with an axial flame opening and a flame baffle element disposed at a distance from the flame opening which is constructed so that the flame is diverted into the space between the flame tube and the heat exchanger. In addition, a fire chamber mantle can be disposed between the heat exchanger and the flame tube to protect the heat exchanger from direct contact with the flame.

21 Claims, 6 Drawing Sheets

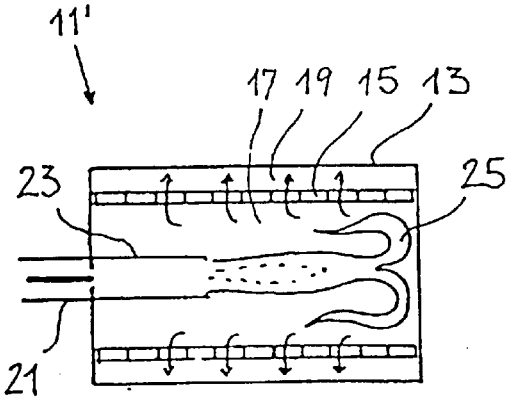
Fig. 1.1
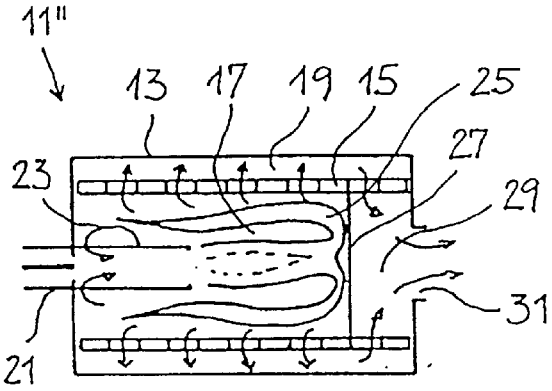
Fig. 1.2
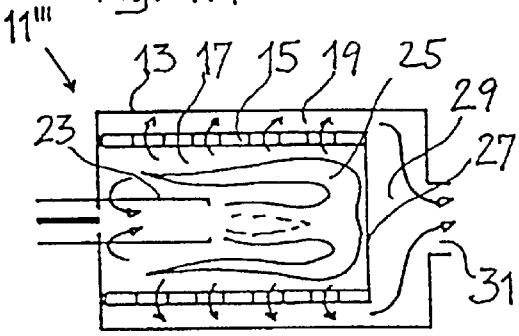
Fig. 1.3
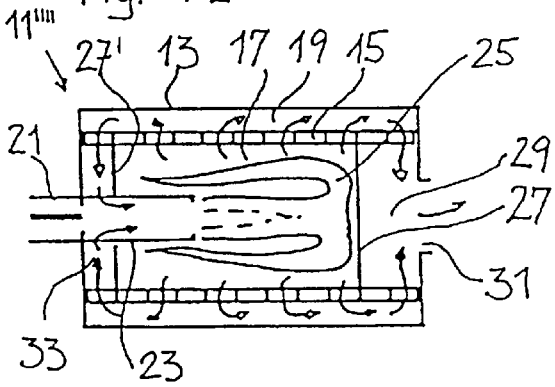
Fig. 1.4
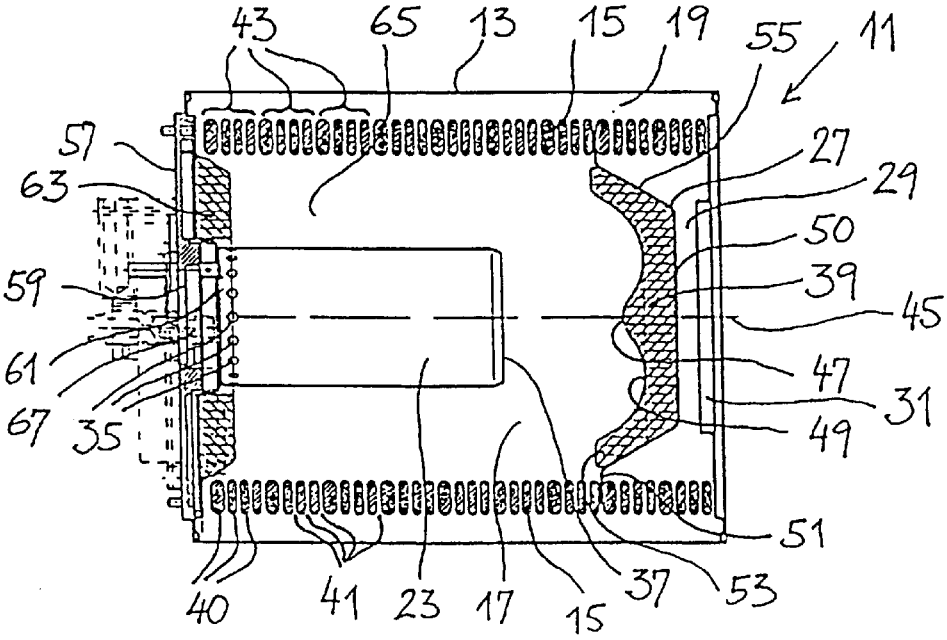
Fig. 2

BOILER FITTED WITH A BURNER

This is a 371 of PCT/CH98/0012, filed Mar. 23, 1998. The Swiss priority documents, application numbers CH 1997 Jul. 18, 1997, CH 1997 Jul. 19, 1997, and CH 1997 Jul. 20, 1997, are still pending.

BACKGROUND OF THE INVENTION

1. Field of the Invention

The present invention relates to a boiler or water heater equipped with a burner, including a housing surrounding a boiler compartment, a cylindrical heat exchanger, which divides the boiler compartment into a combustion chamber, and an exhaust chamber; whereby said heat exchanger comprises passages distributed across its surface for the hot exhaust gas, and a burner head positioned in the combustion chamber.

2. Review of the Prior Art

Such a boiler or water heater is disclosed in the French Patent document No. 93 00498, and is incorporated herein by reference. It contains a number of boiler designs, which exhibit the above-mentioned design features. These boilers are designed to accommodate gas burners and comprise a cylindrical casing with the sides closed off, and a plurality of flame openings distributed across the surface area. Such a gas-fired boiler or water heater is space-saving in its design and does not require a separate furnace room.

It has been a long-standing desire for such a space-saving furnace to be capable of being operated with fuel oil. The disadvantage of using gas as fuel is the more complex fuel storage requirements as compared to oil. As a result, the gas furnace has to rely on either an expensive pressurized tank or on a connection to a gas distribution network. Oil, on the other hand, has been stored in sufficient quantities in tanks located at the site of the furnace in thousands of installations without any problems. Additionally, the supply and filling of the tanks with oil is substantially simpler and less dangerous as compared to gas.

It is therefore the purpose of the invention to provide a furnace, which can be operated by an oil burner without making it larger than a comparable gas furnace. Furthermore, the furnace should be capable to be operated with a gas or an oil burner. Additionally, it is an objective of this invention to provide a furnace characterized by low exhaust emissions, reduced heat loss, and low noise levels.

SUMMARY OF THE INVENTION

The objectives are met, in accordance to the intent of this invention, by adding a fire tube comprising an axial flame opening and a flame deflection piece positioned at a distance to the flame opening to the burner head; whereby, the fire tube is designed in such as manner that the flame between the fire tube and the heat exchanger is deflected.

One of the advantages of a furnace designed per this invention is that it can be operated by burners, which produce a lance-shaped flame. Such a flame usually requires a very long combustion chamber. A flame deflection piece, designed in accordance to this invention, allows the length of the combustion chamber to be significantly reduced. The deflection piece turns the flame back to its origin and, as a result, reduces the length of the combustion chamber by ½. This allows the combustion chamber to be almost fully saturated by the flame exiting the fire tube which is subsequently being deflected into the opposite direction. The deflection of the flame to its origin has the further advantage that very hot gas is present around the fire tube very soon after the flame is initiated, enhancing the cold start characteristics of the furnace. Another advantage of deflecting the flame in the above-described manner lies in the fact that the combustion chamber can be utilized much more effectively and, therefore, can be designed in a more compact fashion as compared to those systems that produce a long, thin flame. More specifically, because of the burner head being surrounded by the flame, the entire length of the combustion chamber is more thermally uniform and therefore better-suited to exchange heat energy to the heat exchange medium.

It is advisable for the heat exchanger to comprise a blocking plate, which effectively limits the combustion system in lengthwise direction. In addition to the exhaust chamber, this creates an additional chamber into which exhaust gas flows from the exhaust chamber. The exhaust gas is cooled by the heat exchanger and is partially re-circulated back to the fire tube in order to cool the flame, and partially exhausted through the flue. A preferred blocking plate design separates the discharge chamber from the boiler compartment at its side facing away from the combustion chamber, whereby said discharge chamber is connected to the flue. Such a discharge chamber resides axially inside the boiler. This allows a uniform flow of the exhaust gas from peripheral the areas into the discharge chamber. This avoids non-uniform thermal loading issues of the heat exchanger. It is preferred for the blocking plate to separate a re-circulation chamber from the boiler compartment. Cooled exhaust gas can then re-circulate through this re-circulation chamber into the fire tube in order to cool the flame. The re-circulation chamber can also serve the function of a discharge chamber. It would be preferred, if the discharge chamber and/ or re-circulation chamber (separated by the blocking plate) were surrounded by the heat exchanger. This allows additional cooling of the exhaust gas entering these chambers prior to leaving the furnace. As a result of the dual contact with the heat exchanger, the exhaust gas is cooled to approximately 80 degrees C., at continuous operation under full load. This allows for the exhaust gas to be piped directly into a flue (made of a plastic compound) upon exiting the boiler.

Further, it would be preferred that the blocking plate between the combustion chamber and the exhaust discharge chamber is shaped in a curved manner in such a way as to allow an increase in the length of the combustion chamber while minimizing the space requirements of the exhaust discharge chamber. Such a design feature results in a relatively large ratio of the heat exchanger surface surrounding the exhaust discharge chamber with respect to its volume.

In order to reduce the number of required parts, the flame deflection piece should form the blocking plate. In doing so, the position of the deflection piece in relation to the housing wall has certain acoustic advantages. The domed surface should point towards the exhaust discharge chamber. The purpose of this domed surface is to deflect the flame without the participation of any heat exchange elements, permitting the use of the entire heat exchange area since the deflection piece does not obstruct any passages for the hot exhaust gas. A preferred flame deflector design comprises a flame separator, positioned along the centerline of the flame and a ring-shaped deflector dish, which surrounds the flame separator.

The flame separator divides the flame, and the deflector dish reflects the flame in order to change the flame direction by 180 degrees. The deflector dish should be made circumferentially uniform in order for the flame to retain a uniform shape after its deflection.

The casing of the heat exchanger consists of pipes positioned adjacent to one another with clearance between the pipes; whereby, said pipes are positioned to surround the combustion chamber and are connected to a supply and a return line. The heat exchange pipes should be wound in a screw-like manner. Such a heat exchanger unit is easy to manufacture; it comprises a large surface area and provides for passages between the pipes. Additionally, pipes can be made to thinner wall thicknesses as compared to castings, and therefore offer a more dynamic heat transfer characteristic which is reflected by higher performance at reduced space requirements. It would also be beneficial if this heat exchanger were assembled from a plurality of heat exchanger units. The individual heat exchanger units have the advantage of using shorter pipe lengths, as compared to a single unit having one long pipe system, resulting in higher through-flow velocities.

The heat exchanger units should be connected to the supply and return in parallel. Heat exchanger units using individual elements disclosed in the French Patent No. 93 00498 are applied successfully. The units described in said documents are characterized by a flat cross-sectional area of the pipes, resulting in an increase in the heat exchange area compared to typical pipes with round cross-sectional areas. Furthermore, an essential advantage of these heat exchanger units is due to the fact that these units are in series production for gas furnaces, and are therefore readily available in the marketplace at excellent quality levels.

The burner should be equipped with exhaust gas re-circulation in order to exceed the current regulated emission values, especially during cold starts. Even if gas burners are applied to the boiler described by this invention, it is still preferred to use oil burners, simply because oil can be stored in inexpensive tanks, which can be readily refilled. The dependence on a supply distribution network can thus be avoided. Furthermore, the handling of oil is much less hazardous as compared to the handling of gas, which must be stored under pressure in appropriate tanks, in cases where it is not supplied through a gas distribution network.

It would be of benefit, however, to have the capability of the burner to operate on both fuels, oil as well as gas. If the burner head is designed to accommodate oil as well as gas, both fuels can be used in the same furnace alternatively with only minimal effort. This has the advantage that price changes and supply shortages can be dealt with in a more proactive fashion, or in a case of having to wait for a hook-up to be in place to provide gas to the furnace, oil can be used as a temporary means to power the furnace until the gas supply is secured.

For oil operation, an injector sprays oil into the exhaust gas being re-circulated into the fire tube; the inlet openings into the fire tube for fresh air as well as exhaust are designed so that fresh air and exhaust are mixed together inside the hollow cylinder or the hollow truncated cone making up the turbulent zone. As the oil mixes with the exhaust, it fully evaporates prior to its mixing with air. This assures very low exhaust emission values and an excellent starting behavior of the burner.

For gas operation, an air supply passage is used for introducing the gaseous fuel. The inlet openings into the fire tube for the fuel/air mixture and the re-circulated exhaust gas, respectively, are designed so that fuel/fresh air mixture and the exhaust are mixed together inside the hollow cylinder or the hollow truncated cone making up the turbulent zone. Because of these similar methods of introducing the fuels, the same fire tube can be applied to both fuels, gas and oil. It is feasible, to leave the oil injector in place during gas operation and to leave the gas supply system in place during oil operation, in order to provide a dual-fuel furnace with a single burner. A system, such as the one described above, is capable of achieving exhaust emission values of below 60 mg Nox per KW when operating on oil and under 20 mg Nox per KW when operating on gas. The CO values also lie under 20 mg Nox per KW at a very low level. In addition to these very low emission levels, the furnace is capable of performing very well under cold start conditions.

In the combustion chamber, in the area between the fire tube or deflected flame and the heat exchanger, resides a cylindrical combustion chamber shroud, comprising openings for the hot combustion gas. This combustion chamber shroud provides a uniform distribution of the hot combustion gas to the heat exchanger and also serves as an ash collector. It protects the heat exchanger from direct contact with the flame. This allows the distance between the flame and the heat exchanger to be very small. Additionally, this combustion chamber shroud has a positive influence in terms of noise suppression. The openings are arranged so that the combustion gas exits the combustion chamber shroud tangentially in order to facilitate the flow of the gas through the heat exchanger casing to also occur in a tangential direction. This improves the heat transfer as compared to a system that utilizes a radial through-flow direction.

The housing of this unit should be proportioned to be similar in size of a wall heating unit or a "plug-in" kitchen unit. The housing, including the air supply line and exhaust line, should have a length of approximately 50 cm. A short design should be able to operate with a boiler length of 30 cm. This means that a separate room for this furnace is not required. It can be stored in a cabinet. The air supply line should surround the exhaust gas line in a counter-flow arrangement in order to pre-heat the incoming air by the warm exhaust gas. The blower should be placed next to the housing with the air supply line leading from the blower to the end face of the housing and the burner head, in order to minimize the length and depth of the unit.

It is practical to line the end faces of the combustion chamber with fireproof tiles with a labyrinth-like inner structure. These protect the underlying metal pats, isolate tho housing from the heat of the flame, and dampen the sound emissions of the burner. It is furthermore appropriate to provide one end face of the housing with a removable cover. It would be advantageous to mount the burner on this cover because this allows easy access to the boiler compartment and the burner.

It is further advisable to use authentic stainless steel, which resists the aggressive exhaust gas and condensates.

BRIEF DESCRIPTION OF THE DRAWINGS

The invention will now be described by way of reference to the drawings, where:

FIG. 1.1–1.4 shows schematically four arrangements of boilers;

FIG. 2 shows a longitudinal cross-sectional view, of the boiler according to the preferred embodiment of the invention;

DETAILED DESCRIPTION OF THE PREFERRED EMBODIMENTS

Figure 3:
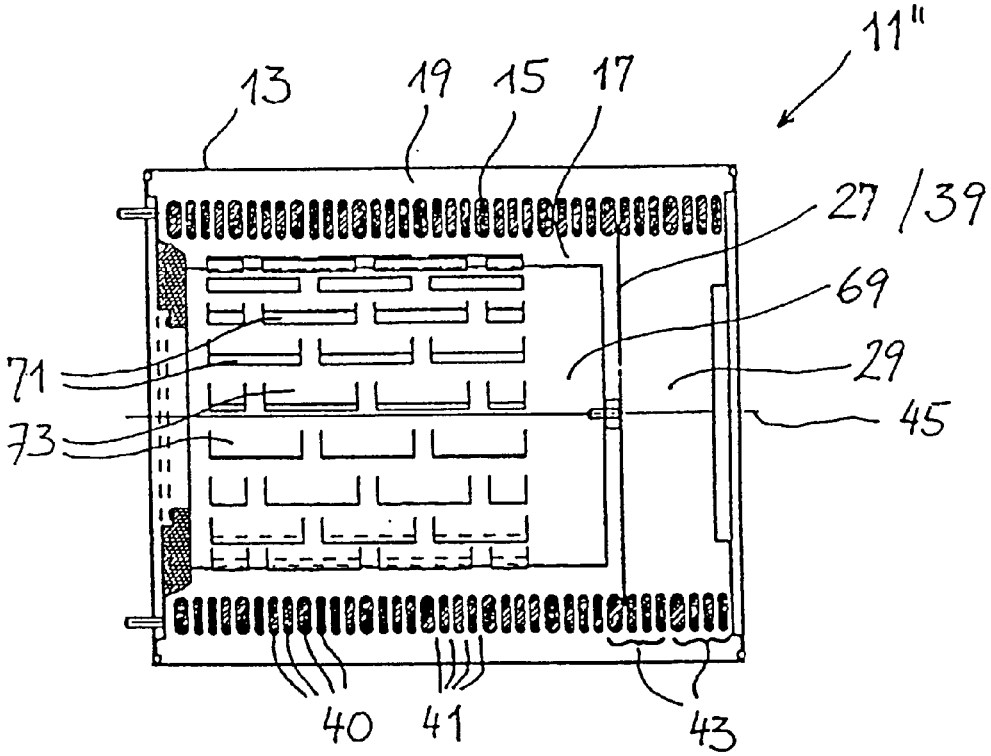
FIG. 3 shows a longitudinal cross-sectional view, of the boiler with a combustion chamber shroud according to the preferred embodiment of the invention.

FIG. 1.1 depicts schematically a simplified illustration of a boiler 11' in accordance to this invention. Housing 13 is divided by heat exchanger 15 into a combustion chamber 17 and an exhaust chamber 19. Fire tube 23 is positioned at one of the end faces of the combustion chamber 17; flame 25 exits the fire tube axially. Fresh air flows through the mixing pipe 21 into the fire tube 23, leading to combustion in flame 25 and subsequently flows as hot combustion gas through the passages in heat exchanger 15 into the exhaust chamber 19 (arrows). From there, the combustion gas exits the exhaust chamber 19 through an opening not shown in FIG. 1) in housing 13. FIG. 1.2 illustrates a design variation, whereby, a blocking plate 27 limits the length of the combustion chamber 17 in boiler 11".

The boiler compartment is thereby divided into 3 zones: The combustion chamber 17, the exhaust chamber 19 and an exhaust discharge chamber 29. The exhaust gas now flows from the exhaust chamber first through the heat exchanger 15 into the exhaust discharge chamber 29, and from there, through an opening 31 into the flue. FIG. 1.3 depicts a simplified version of the FIG. 1.2; here, the heat exchanger 15 does not separate the exhaust chamber 19 from the exhaust discharge chamber 29, but simply surrounds the combustion chamber 17. Arrows in FIGS. 1.2 and 1.3 indicate how the exhaust gas is being re-circulated into the fire tube 23. FIG. 1.4 displays a boiler 11"" in whose boiler compartment an additional blocking plate 27' is added to blocking plate 27. This additional blocking plate creates a recirculation chamber 33. The re-circulating exhaust gas from combustion chamber 17 reaches the re-circulation chamber 33 after having traversed through heat exchanger 15, the exhaust chamber 19, and, again, through the heat exchanger 15. Once there, it is being drawn into the fire tube 23 through its re-circulation openings.

FIG. 2 displays via a cross-sectional view through an embodiment of boiler 11 including the heat exchanger 15, the combustion chamber 17, and the exhaust chamber 19. Combustion chamber 17 contains fire tube 23, which comprises re-circulation openings 35 and one flame opening 37. The heat exchanger 15 consists of pipes 40 with a flat cross-sectional area, which are wound in a screw-like manner. The pipes 40 are positioned at a distance from one another, so that exhaust gas can flow through the gaps 41 between the pipes 40 of the heat exchanger 15. The heat exchanger 15 consists of individual elements 43, which are connected in series and/or parallel to a supply and a return line, respectively. Opposing the flame opening is a deflector piece 39. This deflector piece 39 forms a blocking plate 27 or is connected to a blocking plate 27. The blocking plate 27 is positioned between two pipes 40 or between two elements 43, so that the hot exhaust gas is forced to flow from the combustion chamber 17 through the gaps 41 into the exhaust chamber 19 and from there, once again through the pipes 40 into the exhaust discharge chamber 29. The exhaust gas can then finally exit the exhaust discharge chamber 29 via a passage 31 into the flue or into an exhaust pipe.

The deflection piece 39 comprises an elevated area 47 on axis 45 of the fire tube 23 or boiler 11, which is facing the flame and symmetrically separates the flame. The flame is subsequently re-directed into a direction, opposite its original direction and impacts in the area between the fire tube 23 and the heat exchanger tubes 40 against the root of the flame. This effect creates an approximately cylindrical flame body equal to approximately twice the fire tube diameter. The hot exhaust gas exits through the gaps 41 between the pipes 40 throughout the length of the combustion chamber 17, causing an energy exchange with the exchange medium flowing through the pipes 40.

The deflector piece 39 exhibits a dish-like shape and is positioned with its floor near the end face of housing 13, which is positioned opposite to the fire tube. The inner diameter 51 connects with the outer diameter 53 of the dish-shaped deflector 49; whereby, the surface created by 51 and 53 seats flush against the heat exchange pipes 40. Surface 55 of the deflector piece runs from the inner diameter 51 away from the heat exchange pipes in a slanted fashion, so that none of the pipes 40 are obstructed by the depth occupied by the deflector piece 39, thereby allowing passage of the exhaust gas. The space occupied by the dish-shaped deflector piece 39 goes on the expense of the exhaust discharge chamber 29, which, as a result, is reduced to the minimum required. Because of the shape of blocking plate 27, the combustion chamber 17 increases in length towards the exhaust discharge chamber 29. This allows the length of the boiler to be reduced to a minimum.

On the side of the boiler 11 that houses the burner head resides cover 57, which is bolted against housing 13. Cover 57 comprises an opening 59 on whose inside resides a panel or baffle plate 61, onto which the fire tube 23 is mounted. A ring-shaped disk 63 is positioned at a distance around the fire tube 23. This disk is made of fireproof, porous, or felt-like material and because of its insulating properties, tends to reduce heat loss and noise emissions. The deflector piece 39 has the same structure and, therefore, the same effect.

The fire tube 23 comprises re-circulation openings 35 located near the baffle plate 61, through which exhaust gas is being circulated into the fire tube from the area 65 between the heat exchanger 15 and fire tube 23. The exhaust envelops an air stream, which is being centrally admitted into fire tube 23. This causes the fire tube to be surrounded by hot exhaust gas upon ignition of a flame and therefore heats up rapidly. An oil injector 67 is provided for liquid fuel operation, which sprays the fuel through the centered airflow into the shroud-like exhaust flow enveloping the airflow. The fuel evaporates within the exhaust flow. The evaporated fuel mixes with the air and exhaust in a turbulent fashion. The flame burns in blue color since all the fuel is converted into gaseous fuel prior to the generation of a flame.

The same burner head can be used for operation with gas. However, the gaseous fuel should be introduced into the low-pressure side of the air blower. A shroud of exhaust, having been re-circulated through the recirculation openings 35 into fire tube 23, envelops the incoming air/fuel stream, mixes with said air/fuel stream in the swirl zone between the shroud and core flow and, as a result, the flame burns very similar to the flame generated by the evaporated liquid fuel.

The fire tube 23 becomes hot with both fuels and transfers a certain amount of energy onto the heat exchanger 15 through radiation. This effect is desired, especially since blue flames have relatively little radiation energy. Exhaust emission values are very low with both fuels. Nox emissions are under 60 mg Nox per KW when operating on oil and below 20 mg Nox per KW when operating on gas. The CO values also lie under 16 mg Nox per KW at a very low level.

Burners that are built and functioning per the above-described methodology are described in detail in the submitted European notifications "process and devices for combusting liquid fuel" and "process and devices for combusting gaseous fuel", both of which are based the Swiss priority notifications No. 1997 Jul. 18, 1997 and Jul. 19, 1997, respectively.

Figure 4:
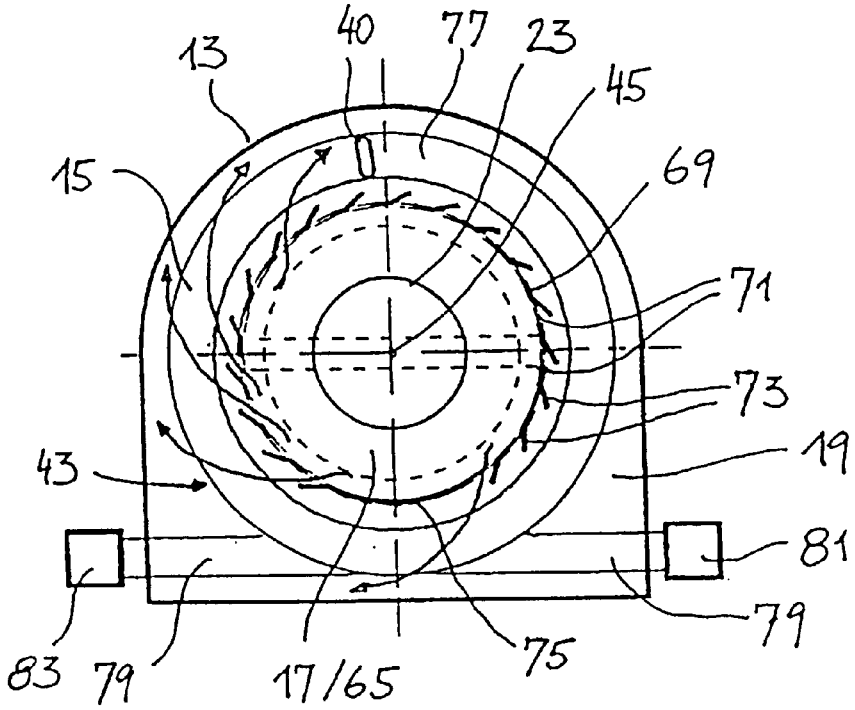
FIG. 4 shows a cross-sectional view of the embodiment according to FIG. 3.

FIGS. 3 and 4 illustrate an additional embodiment of a boiler in accordance to this invention. FIG. 3 depicts a longitudinal cross-section of a boiler; FIG. 4 depicts a cross-section in the transverse direction of the same boiler. In this boiler 11, the blocking plate is designed as a simple deflector plate without a specific form. A further substantive difference relative to the boiler 11 shown in FIG. 2 is the presence of a combustion chamber shroud 69 in combustion chamber 17 on the burner side of heat exchanger 15. The combustion chamber shroud 69 comprises slots 71 on its cylindrical outer surface, as well as guide plates 73, which serve to release the hot exhaust gas from the inner area of the combustion chamber 17 and to guide the gas by means of a rotating flow field around axis 45 through the gaps 41 located between the pipes 40 of the heat exchanger 15 (ref. Arrows in FIG. 4). The flame is reflected back to the end face of housing 13 near the fire tube via the area between fire tube 23 and the combustion chamber shroud 69. The combustion chamber shroud directs the exhaust gas into a spiraling motion.

The bottom area 75 of the combustion chamber shroud contains a zone without any slots 71. This allows any ash present on the combustion chamber shroud to collect at the bottom 75 for easy removal. The combustion chamber shroud 69 also serves as protection for the heat exchanger 15 as it keeps it from direct contact with the flames. The combustion chamber shroud is therefore closed at the front of the shroud, near the blocking plate 27 or the deflector piece 39 and has no slots 71, through which a partially reflected flame could potentially reach the pipes 40 of the heat exchanger 15.

The screw-like windings 77 of the heat exchanger 15 are connected with a straight connecting piece 79 (FIG. 4) to a supply line 81 and return line 83. The individual heat exchanger units 43 consist of four windings of pipe 40 having a flat cross-sectional flow area and are connected in parallel to the supply line 81 and the return line 83. Local enlargements of the pipe walls (not shown) maintain a distance between the pipes 40 of the windings 77.

Figure 5:
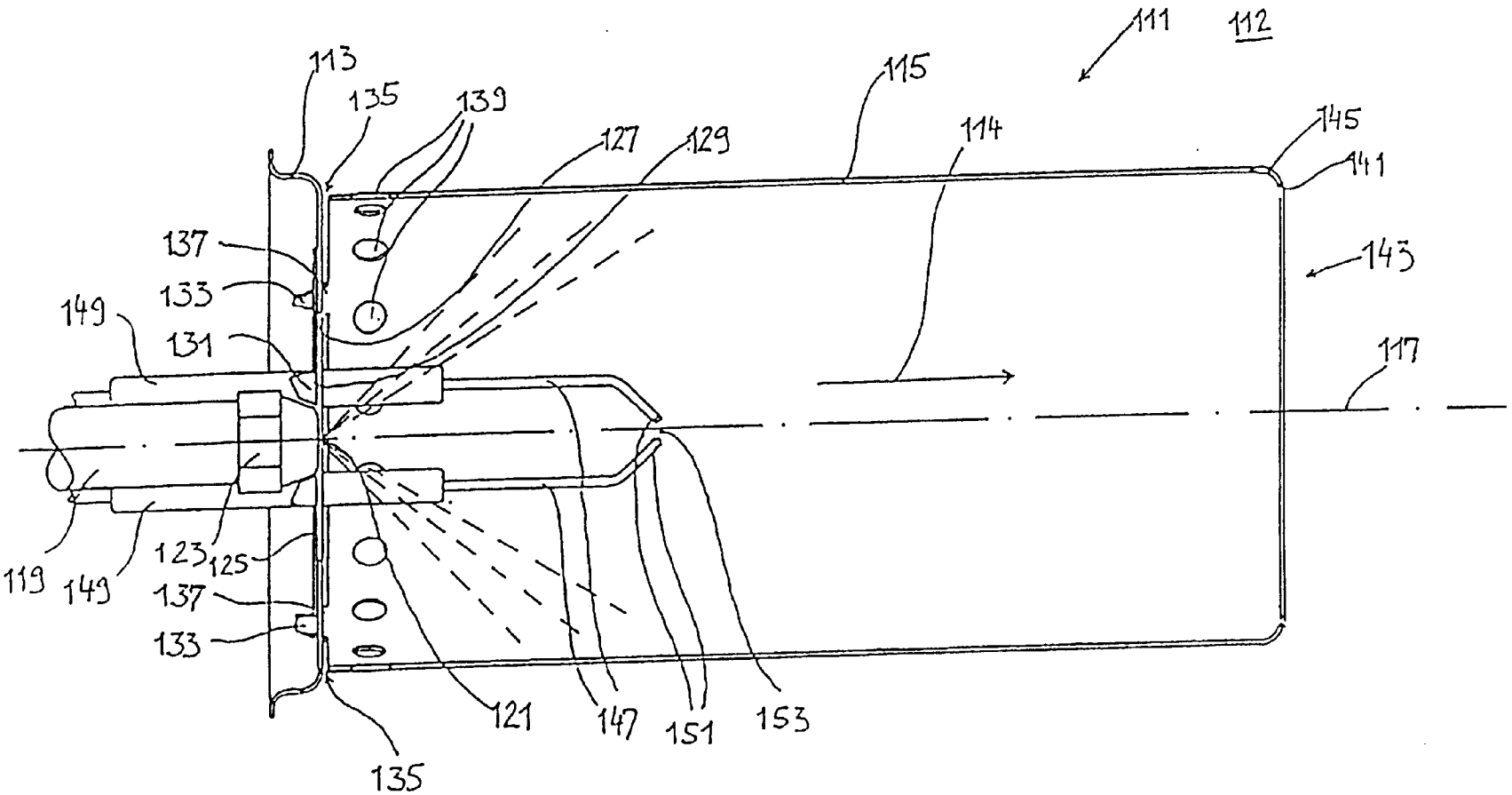
FIG. 5 shows a longitudinal cross-sectional view of an oil burner head according to the preferred embodiment of the invention.

FIG. 5 displays a burner head 111 for liquid fuels, including baffle plate 113, which can be mounted on a wall surface (not shown) of combustion chamber 112. Fire tube 115 is mounted on the baffle plate in direction of the flow (indicated by arrow 114); whereby, said fire tube has a diameter to length ratio of approximately 1:2. In addition, a fuel injector 119 is positioned along the centerline 117 of the fire tube. The devices used to mount the fuel injector and the baffle plate 113 form together a panel insert, as described in document No. EPA 0 650 014. The fuel injector head 123 seats centrally in panel insert 125. The spray opening 121 of fuel injector 119 lies in the plane of the baffle plate 113 and the panel insert, respectively. Panel insert 125 is mounted on the baffle plate and covers the opening 127 of the baffle plate 113 but leaves a ring-shaped air vent 129 around the fuel injector head 123 open. This ring-shaped air vent 129 occupies an area of approximately 8% of the cross-sectional area of the fire tube 115.

Figure 7:
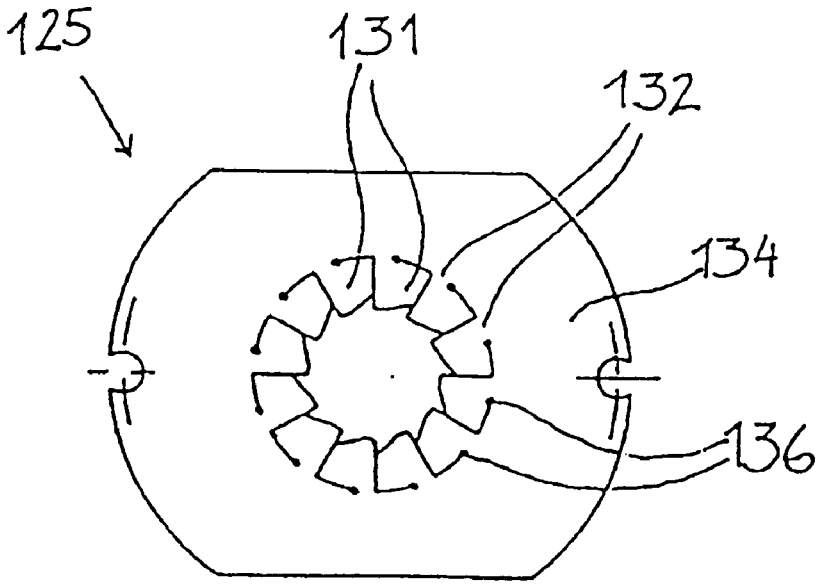
FIG. 7 shows a top view of a panel insert with guide plates cut out but not twisted.
Figure 8:
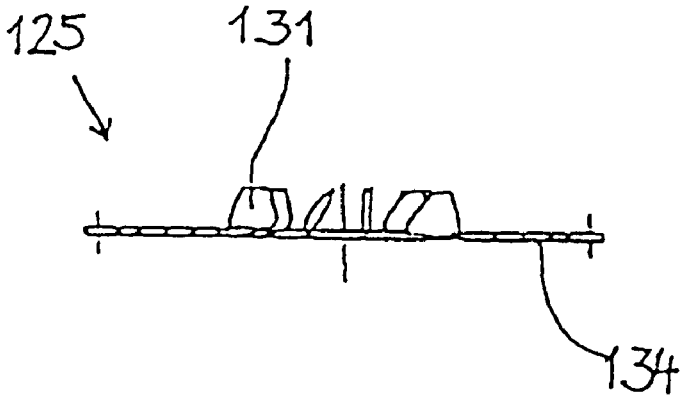
FIG. 8 shows a cross-section through a panel insert according to FIG. 7; whereby, the guide plates are twisted for swirl generation.

Air vent 129 is furthermore equipped with swirl generating guide plates 131. These guide plates 131 are positioned radially and are slanted relative to the centerline 117 of fire tube and the direction of flow 114, so that air flowing through air vent 129 is energized into a rotary motion around centerline 117. The guide plates 131 are manufactured from one piece together with the panel insert 125 (FIG. 7 and FIG. 8). The guide plates are cut or stamped from the panel insert 134 and subsequently twisted by 60 to 80 degrees relative to the mounting surface. In doing so, round cut-outs are added in the area of the metal that receive most of the deformation as a result of the twisting action, in order to prevent the initiation of cracks (ref. 136 in FIG. 7).

Fire tube 115 is mounted on the baffle plate 113 by means of connecting tabs 133. These connecting tabs 133 are formed as a single unit with the wall surface 139 of fire tube 115, protrude above the end of fire tube 15 facing the baffle plate and are inserted through slots in the baffle plate 113. On the upstream side of the baffle plate 113, the connecting tabs are twisted upon insertion so that a tight connection between the baffle plate 113 and fire tube 115 is established.

The connecting tabs 133 are shaped in step-like manner, becoming smaller towards the end. The steps 137 in the tab contact the baffle plate 113 on the side of the fire tube and define the opening width of the recirculation slots. Exhaust gas is being drawn through this re-circulating slot 135, along the baffle plate 113 and the panel insert 125 into the fire tube 115 in order to avoid soot in this area. A favorable opening width is approximately 1 mm.

The fire tube 115 comprises recirculation openings 139 near the baffle plate, through which exhaust gas is being drawn, primarily due to the sub-atmospheric pressure which is generated downstream of the baffle plate 113 as a result of the present air flow. In the case being described, there are 18 circular recirculation openings 139, each with a diameter of 6 mm. The openings 139 can be lower or higher in number and/or can also be shaped differently.

The fire tube 115 comprises an inner tube diameter of approximately 80 mm and a length of 160 mm. The end of the fire tube 15 facing the combustion chamber 112 is narrowed. This contraction 141 reduces the flame exit area 143 relative to the fire tube cross-sectional area. The outer area of 145 of the fire tube 115 is rounded off towards the inside in order to create the contraction 141.

The spark electrodes 147 are inserted through the baffle plate 13 near the periphery of the fire tube 115 with insulating elements 149 and protrude with their ends 151 into the fire tube 115. The point 153 at which the spark is generated is placed at a distance from the baffle plate 113 equal to approximately ⅖ of the length of fire tube 115.

Figure 6:
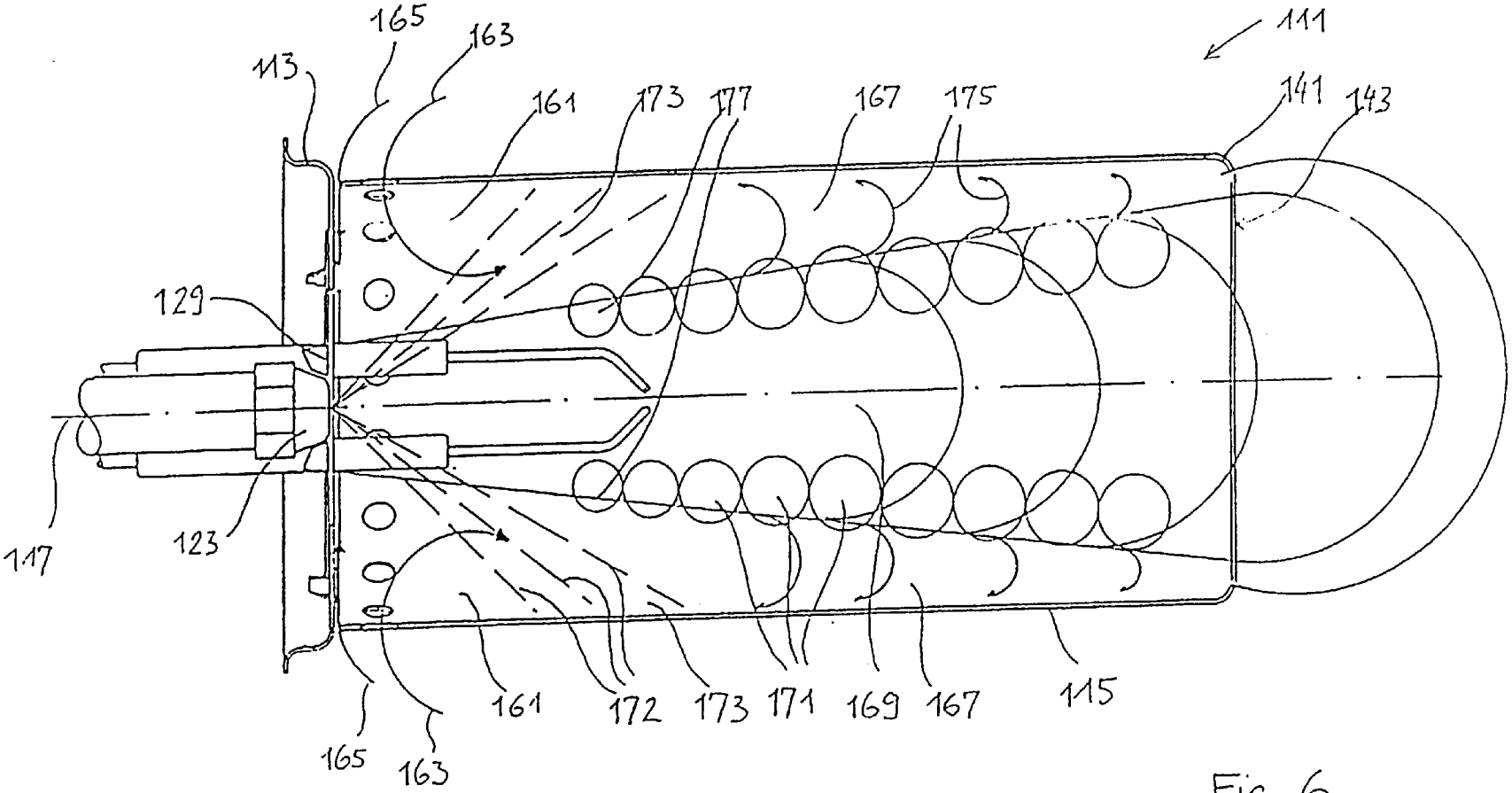
FIG. 6 shows a schematic view of the combustion process using liquid fuel.

FIG. 6 displays the various zones during combustion schematically. Because of air being forced through the air opening 129, a sub-atmospheric pressure is being generated in area 161, downstream of the baffle plate 113. Through this sub-atmospheric pressure, exhaust gas is being drawn into the combustion zone as indicated by the arrows 163 and 165. The exhaust gas forms a shroud 167 around the core of flow 169. The exhaust gas entering along arrow 165 moves along the outer surface of the baffle plate and thus protects it from carbon deposits. Regions of turbulences 171 are being generated in the area between the core flow 169 and the exhaust shroud 167, which facilitate mixing of the two mediums, air and exhaust.

The fuel is introduced into the airflow along the shortest way possible, as depicted by the dashed lines 172. The conical shroud of the spray plume comprises an angle of between 60 and 90 degrees. The fuel injector should preferably be designed to provide a spray plume angle of 80 degrees. The fuel evaporates in the area 173 of exhaust shroud 167 and mixes inside the exhaust shroud with the exhaust gas by means of the turbulences 175 generated in this area. Since there is no fuel present upstream of the evaporation zone 173 that could ignite, and because of the short distance that the fuel has to travel through the airflow 169, practically all of the fuel is evaporated in the exhaust shroud 167 by the time it comes in contact with fresh air to initiate combustion.

Evaporated fuel is mixed with the exhaust gas and air inside the turbulences 171 and combustion initiates only in the area of said turbulences 171 with only minimal emissions.

The flame begins to develop in its root area 177, approximately at the end of the first third of fire tube 115. The flame root is embedded in the shape of a ring in the area between the exhaust shroud 167 and air stream 169. The center air stream 171 terminates near the last third of the fire tube and serves to cool the tube. The thickness of the exhaust shroud 167 is decreasing as it traverses downstream, while the exhaust/fuel mixture mixes with air along the same distance. The fuel vapor is being supplied to the flame over a distance of approximately two thirds of the length of the fire tube. Thus, the flame has a ring-shaped, long-drawn root region and is being fed by shroud 167.

Because of the contraction 141 of the fire tube, shroud zone 167 is limited in the downstream direction. The gas in the shroud region 167 is impeded while exiting the fire tube, which favors a mixing of the two media. Inside the fire tube, the exiting flame remains stable.

Figure 9:
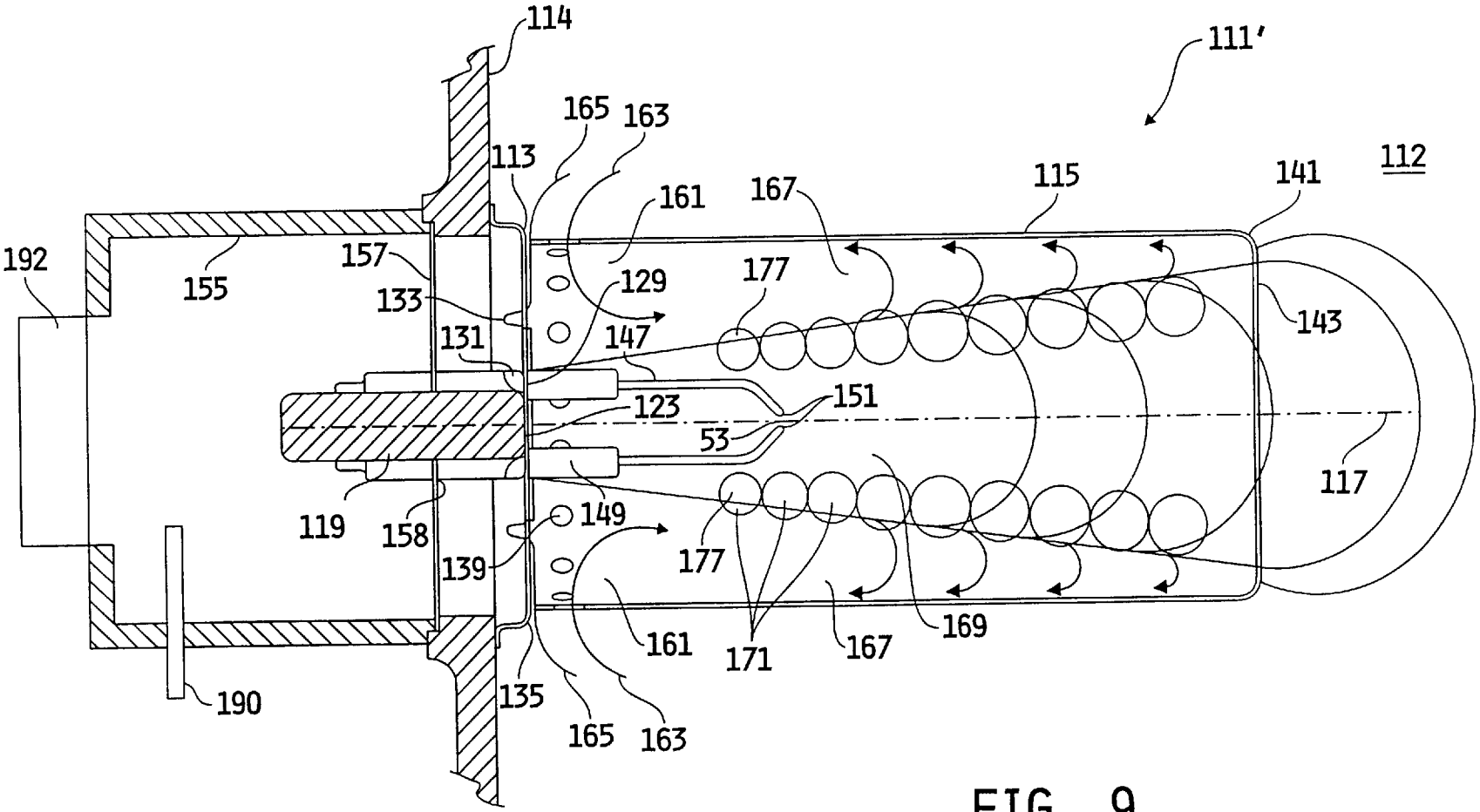
FIG. 9 shows a longitudinal cross-section of the gas burner head and schematic of combustion process using gaseous fuel.

FIG. 9 illustrates schematically burner head 111' for operation with gas and the different zones present during combustion of gaseous fuel. Burner head 111' corresponds, in essence, to burner head 111 for liquid fuels. However, a perforated plate 157 is positioned downstream in front of the baffle plate 113 and a distance to said baffle plate 113. The perforated plate 157 comprises an opening 158 through which the oil injector 119 penetrates. Several holes are placed around this area which serve to create a pressure loss designed to avoid a blow-back of the flames into the supply passage 155. A fuel supply line 190 and a blower 192 are attached to the supply passage.

Since the air/fuel mixture is forced through passage 129, a sub-atmospheric pressure is created in area 161, downstream of the baffle plate 113. Because of this sub-atmospheric pressure, exhaust gas is being drawn into this area, as indicated by arrows 163 and 165. The exhaust gas forms a shroud 167 around the core flow 169. The exhaust gas entering along arrow 165 flows along the surface of the baffle plate, which serves to protect it from excessive carbon or soot deposits. Turbulence is generated between the core flow 169 and shroud 167 within which the two media air/fuel and exhaust are being mixed. Gaseous fuel is mixed with air and exhaust gas inside the turbulence 171, and combustion initiates only in the region of said turbulence 171 with only minimal emissions.

The flame begins to develop in its root area 177, approximately at the end of the first third of fire tube 115. The flame root is embedded in the shape of a ring in the area between the exhaust shroud 167 and air stream 169. The center air stream 171 terminates near the last third of the fire tube and helps cool the tube. The thickness of the exhaust shroud 167 is decreasing as it traverses downstream, while the exhaust/fuel mixture mixes with air along the same distance. The flame bums steadily with only minimal emissions.

The gas burner, designed in accordance to the intent of this invention, functions practically independently of the form or shape of the combustion chamber. It is especially suited for compact furnace designs with relatively short combustion chambers. The burner is not only suitable for burning gas. By replacing item 119 by a fuel injector that is appropriate for liquid fuels with the capability of generating a conical shroud spray pattern, the burner is then suitable for the combustion of heating oil extra light, "Eco-oil" or kerosene. With liquid fuels, the burner achieves exhaust emission values for Nox of less than 60 mg/KW.

What is claimed is:

1. A fuel burning boiler, comprising a boiler housing, a burner head within said housing, a cylindrical heat exchanger dividing the boiler compartment into a combustion chamber and an exhaust chamber, and a flame deflector, said heat exchanger comprising passages distributed across its cylindrical surface for the hot exhaust gas to flow between said combustion chamber and said exhaust chamber, said burner head being positioned in the combustion chamber and comprising a fire tube with an axial flame opening directed at said flame deflector, said deflector being positioned at a distance from the flame opening, and being profiled such that the flame is deflected to the area between the fire tube and the heat exchanger.

2. The boiler of claim 1, wherein a chamber is separated from said boiler compartment.

3. The boiler of claim 2, wherein said chamber is located distant from said fire tube and forms an exhaust gas chamber from said boiler compartment.

4. The boiler of claim 3, wherein the flame deflector comprises a domed surface pointing towards the exhaust discharge chamber.

5. The boiler of claim 2, wherein the chamber is proximate to the fire tube and forms a re-circulation chamber from the boiler compartment.

6. The boiler of claim 2, wherein the chamber is surrounded by the heat exchanger.

7. The boiler of claim 1, wherein the flame deflector comprises a flame separator, positioned along the flame centerline and facing the flame, and a ring-shaped deflector dish, which surrounds the flame separator.

8. The boiler of claim 3, wherein the flame deflector includes a blocking plate, which extends radially outwardly to said heat exchanger, thereby defining said exhaust gas chamber.

9. The boiler of claim 1, wherein the heat exchanger consists of pipes positioned adjacent to one another with clearance between the pipes; whereby said pipes are positioned to surround the combustion chamber and are connected to a supply and a return line.

10. The boiler of claim 1, wherein the outer shell of the heat exchanger is assembled from a plurality of heat exchanger units.

11. The boiler of claim 10, wherein the heat exchanger units are connected in parallel to the supply line and the return line.

12. The boiler of claim 1, wherein one end face of housing can be closed off with a cover onto which the burner head is mounted.

13. A fuel burning boiler, comprising a boiler housing, a fire tube within said housing, a cylindrical heat exchanger dividing the boiler compartment into a combustion chamber and an exhaust chamber, a flame deflector piece creating a deflected flame, and a cylindrical combustion chamber shroud with passages for hot exhaust gas positioned in the combustion chamber between the fire tube and deflected flame, and the heat exchanger, the passages being so that the exhaust gas exits the combustion chamber shroud tangentially, the combustion chamber shroud being closed off near the blocking plate or the flame deflector piece.

14. The boiler of claim wherein the cylindrical combustion chamber shroud is closed off in a bottom area.

15. A fuel burning boiler, comprising a housing and a burner head positioned within said housing, said burner head being equipped with a centrally mounted fuel injector, capable of producing a conical shroud spray pattern, a baffle plate with an air vent, a fire tube positioned adjacent and downstream of the baffle plate; whereby the fire tube comprises openings near the baffle plate to allow exhaust gas to enter a sub-atmospheric pressure region behind and downstream of the baffle plate; and wherein the spray opening of the fuel injector is positioned approximately in the plane of the baffle plate, which generates the sub-atmospheric pressure the baffle plate comprising an opening, forming a ring-shaped, concentrically located, with respect to the fuel injector, air inlet passage.

16. The boiler of claim 15, wherein the burner is equipped to burn oil.

17. The boiler of claim 15, wherein the burner is equipped to burn gas.

18. The boiler of claim 17, with a blower and a fuel supply for gaseous fuel, wherein the fuel supply for gaseous fuel is positioned in the supply passage at such a distance from the baffle plate, that a practically homogenous mixing of fuel and air is ensured in front of the baffle plate, and that the baffle plate closes off the supply passage with the exception of a central passage.

19. The boiler of claim 18, wherein the blower is positioned adjacent to said housing and a supply passage is led from the blower to the end face of housing and onto the fire pipe.

20. The boiler of claim 17, wherein the air vent of the baffle plate comprises swirl-generating guide plates.

21. The boiler of claim 15, wherein the burner is equipped for exhaust gas re-circulation.

* * * * *

UNITED STATES PATENT AND TRADEMARK OFFICE

CERTIFICATE OF CORRECTION

PATENT NO. : 6,305,331 B1
DATED : October 23, 2001
INVENTOR(S) : Jorg Fullemann et al.

It is certified that error appears in the above-identified patent and that said Letters Patent is hereby corrected as shown below:

Column 11,
Line 12, after "claim" insert -- 13, --

Signed and Sealed this

Fourteenth Day of May, 2002

*Attest:*

*Attesting Officer*

JAMES E. ROGAN
*Director of the United States Patent and Trademark Office*